United States Patent [19]

Yoshioka et al.

[11] Patent Number: 4,855,019

[45] Date of Patent: Aug. 8, 1989

[54] ELECTRODEPOSITED GRINDSTONE

[75] Inventors: Hajime Yoshioka; Yukio Kodama, both of Kyoto; Sadato Shigemura; Tohru Funada, both of Hiroshima; Satoshi Morimoto, Kyoto, all of Japan

[73] Assignee: Mitsubishi Jukogyo Kabushiki Kaisha, Tokyo, Japan

[21] Appl. No.: 165,686

[22] Filed: Mar. 9, 1988

[30] Foreign Application Priority Data

Mar. 10, 1987 [JP] Japan ..... 62-53117
Mar. 10, 1987 [JP] Japan ..... 62-53118
Apr. 28, 1987 [JP] Japan ..... 62-103069

[51] Int. Cl.[4] ..... C25D 15/00

[52] U.S. Cl. ..... 204/16; 204/37.1; 204/38.4

[58] Field of Search ..... 204/16, 38.5, 37.1, 204/38.4, 40

[56] References Cited

U.S. PATENT DOCUMENTS 4,381,227 4/1983 Narcus ..... 204/16

FOREIGN PATENT DOCUMENTS 61-274879 12/1986 Japan .

*Primary Examiner*—T. M. Tufariello

*Attorney, Agent, or Firm*—Fleit, Jacobson, Cohn, Price, Holman & Stern

[57] ABSTRACT

An electrodeposited grindstone obtained by embedding abrasive grains in a nickel plated bearing layer due to electrodeposition process and a nickel-phosphorus alloy bearing layer due to chemical plating process formed successively on a grinding part surface of a grindstone base metal. An electrodeposited grindstone obtained by forming a thin plated layer by electrodeposition process on said electrodeposited grindstone which underwent a heat treatment and on the surface of the nickel-phosphorus alloy bearing layer.

3 Claims, 2 Drawing Sheets

ELECTRODEPOSITED GRINDSTONE

FIELD OF THE INVENTION AND RELATED ART STATEMENT

The present invention relates to an electrodeposited grindstone which serves as an abrasive tool.

As shown in FIG. 3 and FIG. 4, a grindstone which serves as an abrasive tool is formed by letting a surface 1a of a grinding part of a base metal 1 of the grindstone bear abrasive grains 2 such as cubic system boron nitride (CBN) and diamond, with a nickel plated bearing layer as a binder. For example, as shown in FIG. 2, a conventional electrodeposited grindstone is manufactured by forming a nickel plated bearing layer 4 which bears abrasive grains 2 by electrodepositing abrasive grains that are suspended in a nickel plating solution, after forming a thin nickel plated layer 3 by electrodeposition on a grinding part surface 1a of a grindstone base metal 1.

Such a conventional electrodeposited grindstone has a nickel plated bearing layer 4 for bearing abrasive grains 2 whose thickness tends to be nonuniform depending upon the form of the surface 1a of the grinding part or the grain size and the condition of distribution in the plating solution of the abrasive grains 2, and further, the hardness of the nickel plated layer itself is not sufficiently large, so that its endurance life is desirous of to be improved a little bit.

OBJECT AND SUMMARY OF THE INVENTION

It is an object of the present invention to provide a strong electrodeposited grindstone by solving the above problems while taking advantage of the nickel plated bearing layer obtained by electrodeposition, namely, that the nickel plated layer by electrodeposition has an excellent bonding property to the grindstone base metal and that the material quality of the layer has a sufficient tenacity.

It is another object of the present invention to provide an electrodeposited grindstone which eliminates the fear of generating cracks or fissures in a nickel-phosphorus alloy bearing layer formed by chemical plating (electroless plating) process.

In order to attain the above objects, an electrodeposited grindstone of the present invention is characterized in that there are formed successively a nickel plated bearing layer due to electrodeposition process and a nickel-phosphorus alloy bearing layer due to chemical plating process on the surface of the grinding part of the base metal of the grindstone, in order to let these layers bear abrasive grains.

In addition, the electrodeposited grindstone of the present invention is characterized in that it is obtained by further subjecting the electrodeposited grindstone which bears abrasive grains, as described in the above, to a heat treatment.

Moreover, the present invention is characterized in that a nickel plated bearing layer due to electrodeposition process and a nickel-phosphorus alloy bearing layer due to chemical plating process are formed successively in order to let these prayers bear the abrasive grains, after giving a surface treatment to the grinding part surface by subjecting it successively to a nickel plated coating due to electrodeposition process and a nickel-phosphorus alloy plated coating due to chemical plating process.

Furthermore, the electrodeposited grindstone of the present invention is characterized in that it is obtained by forming successively a nickel plated bearing layer due to electrodeposition process and a nickel-phosphorus alloy bearing layer due to chemical plating process in order to let these layers bear the abrasive grains, after giving a surface treatment to the grinding part surface by subjecting it sucessively to a nickel plated coating due to electrodeposition process and a nickel-phosphorus alloy plated coating due to chemical plating process, and then subjecting an electrodeposited grindstone thus obtained to a heat treatment.

Still further, the present invention is characterized in that, in an electrodeposited grindstone whose strength and abrasion resistance of the electrodeposited layers, formed by the combination of chemical plating process and electroplating process or by chemical plating process alone for bearing the abrasive grains, are enhanced by subjecting the layers to a heat treatment, a thin electroplated coating is formed on a chemically plated coating in order to prevent the generation of cracks or fissures in the chemically plated layer that is hardened by a heat treatment.

According to the present invention, the overall thickness of a plated layer for embedding the abrasive grains can be made uniform by forming a nickel-phosphorus alloy bearing layer due to chemical plating process (electroless plating process) over a nickel plated bearing layer due to electrodeposition process, so that it is possible to obtain a generally sturdy electrodeposited grindstone with less vulnerable spots.

Moreover, according to the present invention, abrasive grains are embedded in a nickel plated bearing layer due to electrodeposition process and a nickel-phosphorus alloy plated bearing layer due to chemical plating process that are formed successively, over the grinding part surface of the grindstone base metal which is subjected to a successive surface treatment of a nickel plated coating due to electrodeposition process and a nickel-phosphorus alloy plated coating due to chemical plating process. Consequently, there can be obtained a strong electrodeposited grindstone with long endurance life which has a bearing layer with a small dispersion in thickness and a tight bonding between the surface plated layer and the grindstone base metal.

Furthermore, according to the present invention, the nickel-phosphorus alloy plated layer and the nickel-phosphorus alloy plated bearing layer can be hardened to above Hv 800 by subjecting the electrodeposited grindstone to a heat treatment in the range of 150°-550° C., so that an electrodeposited grindstone with a still longer endurance life can be obtained.

Still further, according to the present invention, it is possible to prevent the generation of cracks or fissures in the chemically plated layer of the electrodeposited grindstone which is hardened by a heat treatment.

The abrasive grains to be used for the electrodeposited grindstone of the present invention are hard abrasive grains such as cubic system boron nitride abrasive grains and diamond abrasive grains, but other hard abrasive grains can also be employed. These abrasive grains have a size which is the same as the conventional one.

A grindstone which employs cubic system boron nitride is used principally for grinding of iron family metals while a grindstone which employs diamond abrasive grains is used principally for grinding nonferrous metals.

DETAILED DESCRIPTION OF PREFERRED EMBODIMENTS

Figure 3:
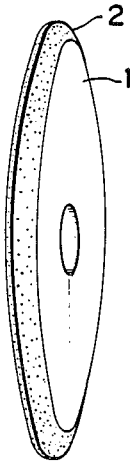
FIG. 3 (PRIOR ART)
FIG. 3 is an external view of an example of abrasive grindstone.
Figure 1:
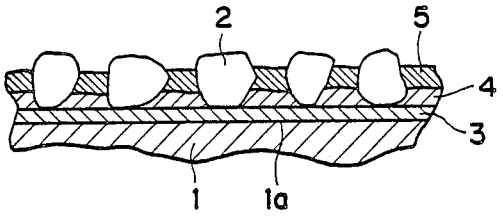
FIG. 1 is a sectional view which shows the bearing condition of abrasive grains in an electrodeposited grindstone in accordance with the present invention.
Figure 4:
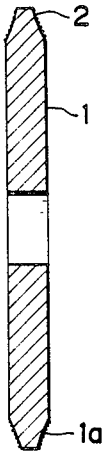
FIG. 4 (PRIOR ART)
FIG. 4 is a sectional view of an example of abrasive grindstone.
Figure 2:
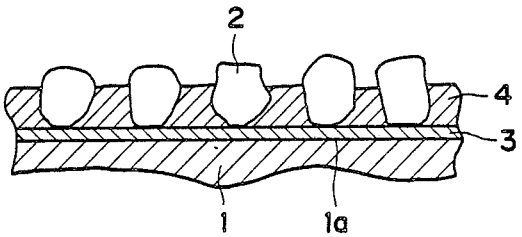
FIG. 2 (PRIOR ART)
FIG. 2 is a diagram which shows the bearing condition of abrasive grains in a conventional electrodeposited grindstone.

In FIG. 1 is shown an example of embedding of abrasive grains in an electrodeposited grindstone of the present invention.

First, a nickel plated coating 3 with thickness of 4 μm is given by electrodeposition process on the surface 1a of the grinding part of the base metal 1 of a grindstone. Next, a nickel plated bearing layer 4 of average thickness of 10 μm which bears abrasive grains 2 is formed by carrying out an electrodeposition in a nickel plating solution which contains cubic system boron nitride (CBN) abrasive grains of #325/400 suspended in it. Then, on top of it there is formed a nickel-phosphorus alloy plated bearing layer 5 of average thickness 20 μm by chemical plating process.

An electrodeposited grindstone of the present invention thus produced is divided into four parts of which three parts were given a heat treatment by heating them at 150, 250°, and 400° C., respectively. The hardness of the heat treated nickel-phosphorus alloy plated bearing layers 5 were all above Hv 800. The remaining one part was not given a heat treatment.

The electrodeposited grindstone which was not given a heat treatment and those that were given a heat treatment at respective temperatures were subjected to a grinding test to be compared with an electrodeposited grindstone with an electrodeposited nickel plated bearing layer 4 of average thickness of 30 μm produced by the conventional method.

The result of the test showed that the endurance life of the electrodeposited grindstones of the present invention was 1.5 times for the specimen which was not given a heat treatment and was 2–2.5 times for the heat treated specimens, of the corresponding life of the conventional electrodeposited grindstone.

Figure 5:
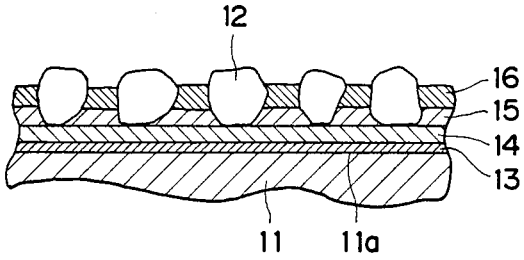
FIG. 5 is a sectional view which shows the bearing condition of abrasive grains in an electrodeposited grindstone for another embodiment of the present invention.

In FIG. 5 is shown another embodiment of the present invention. In the figure, after giving first a nickel plated coating 13 of thickness 4 μm by electrodeposition process on a grinding part surface 11a of a grindstone base metal 11, a nickel-phosphorus alloy plated coating 14 of thickness 20 μm was carried out by chemical plating process. Next, a nickel plated bearing layer 15 of average thickness 10 μm which bears abrasive grains **12*a* was formed by electrodeposition in a nickel plating solution with cubic system boron nitride (CBN) abrasive grains of #325/400 suspended in it. Then, a nickel-phosphorus alloy plated bearing layer 16** of average thickness 20 μm was formed on top of it by chemical plating process.

An electrodeposited grindstone of the present invention thus produced was divided into four parts of which three parts were subjected to a heat treatment by being heated at 150°, 250°, and 400° C., respectively. The hardness after heat treatment of the nickel-phosphorus alloy plated layer 14 and the nickel-phosphorus alloy plated bearing layer 16 were both greater than Hv 800. The remaining one part was not heat treated.

The electrodeposited grindstone which was not given a heat treatment and the electrodeposited grindstone which were given a heat treatment at the respective temperatures were given a grinding test to be compared with an electrodeposited grindstone with an electrodeposited nickel plated bearing layer 15 of average thickness 30 μm obtained by the conventional method.

The result of the test showed that the endurance life of the electrodeposited grindstones of the present invention was twice for the specimen which was not heat treated and 2.5–3 times for those heat treated specimens, of the corresponding life of the electrodeposited grindstone obtained by the conventional method.

It should be noted here that the electrodeposited grindstone in each of the above embodiments of the present invention can be applied as well to other abrasive tools such as a shaving cutter in addition to the application to the ordinary abrasive grindstone.

Figure 6:
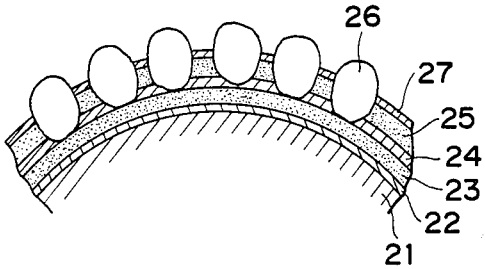
FIG. 6 is a sectional view which shows the bearing condition of abrasive grains in still another embodiment of the present invention.

FIG. 6 shows still another embodiment of the present invention. In the figure, 21 is a grindstone base metal, 22 is an electrodeposited nickel plated layer, 23 is a nickel-phosphorus alloy plated layer due to chemical plating process, 24 is an electrodeposited nickel layer, 25 is a nickel-phosphorus alloy plated layer due to chemical plating process, and 26 is an abrasive grain. The plated layers 22–25 are substantially the same as the corresponding layers for the embodiment shown in FIG. 5. In this embodiment, a thin nickel plated layer 27 of a thickness of about 2 μm was electrodeposited on the surface of a nickel-phosphorus alloy plated layer.

In an electrodeposited grindstone provided with a nickel-phosphorus alloy plated bearing layer due to chemical plating process (electroless plating process), as in the embodiments shown in FIGS. 1 and 5, improvements in the strength and abrasion resistance of the nickel-phosphorus alloy plated layer are attempted by giving the layer a heat treatment. While said plated layer can be hardened by the heat treatment, flexibility of the layer is reduced, tending to create cracks or fissures under severe abrasion conditions, which may lead to a detachment of respective layers with a crack or a fissure as the starting point.

This tendency is particularly strong in a layer, with thickness of more than 30 μm which is obtained by nickel-phosphorus electroless plating, aimed at maintaining uniformity of the electrodeposited layer and improving the accuracy of the grindstone.

After the above nickel plated layer is formed by electrodeposition, the grindstone is subjected to a heat treatment in the range from 150° to 550° C.

The topmost electroplated nickel layer retains relative flexibility without being hardened by the heat treatment so that it serves to relax the compressive force and the tensile stress that act on the nickel-phosphorus layer formed by electroless plating.

It was confirmed by a simulation test using an electrodeposited layer devoid of abrasive grains that due to these circumstances the stress which causes cracks or fissures in the nickel-phosphorus layer formed by electroless plating is improved by 8 to 9 times compared with that in the conventional 4-layered electrodeposition.

Figure 7:
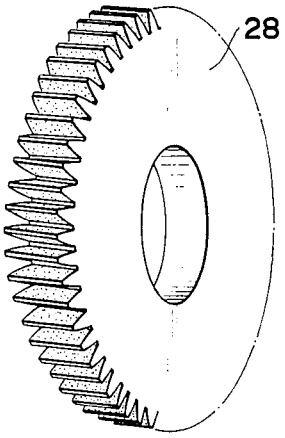
FIG. 7 is a perspective view with a partial omission of the case in which the present invention is applied not to an electrodeposited grindstone but to a gear type shaving tool.

Further, FIG. 7 shows a gear type electrodeposited CBN shaving tool 28 which is an example of application of the present invention not to a grindstone but to a tool.

The electrodeposited grindstone of the present invention prolongs the endurance life to about 1.5–3 times that of the conventional electrodeposited grindstone so that the productivity and economy of abrasion and processing work can be improved remarkably by the use of this grindstone.

Moreover, the electrodeposited grindstone of the present invention possesses an extremely desirable effect in that there will not be generated cracks or detachments of the electrodeposited layers under severe abrasion conditions, making it possible to cope with severer abrasion conditions.

What is claimed is:

1. An electrodeposited grindstone, comprising:

a grindstone of a base metal;

a nickel plating deposited by electrodeposition upon said base metal;

a nickel bearing layer deposited by electrodeposition above said nickel bearing layer;

a nickel-phosphorus alloy bearing layer deposed upon said nickel bearing layer by chemical plating; and a plurality of hard abrasive grains embedded within said nickel bearing and nickel-phosphorus alloy bearing layers;

said grindstone and said nickel plating, nickel bearing and nickel-phosphorus alloy bearing layers having been subjected to heating within a temperature range of between about 150° C. and 550° C.

2. An electrodeposited grindstone, comprising:

a grindstone of a base metal;

a nickel plating deposited by electrodeposition upon said base metal;

a nickel-phosphorus alloy plating deposited by chemical plating upon said nickel plating;

a nickel bearing layer deposited by electrodeposition upon said nickel-phosphorus alloy plating;

a nickel-phosphorus alloy bearing layer deposited by chemical plating upon said nickel bearing layer; and a plurality of hard abrasive grains embedded within said nickel bearing and nickel-phosphorus alloy bearing layer;

said grindstone with said plating and bearing layers having been subjected to heating within a temperature range of between about 150° C. and 550° C.

3. An electrodeposited grindstone, comprising:

a grindstone of a base metal;

a bearing layer of a nickel composition deposited upon said base metal;

a plurality of hard abrasive grains embedded within said bearing layer; and a plating layer of a nickel composition deposed by electrodeposition upon the top most surface of said bearing layer;

said grindstone with said bearing layer and plating layer having been subjected to heating within a temperature range of between about 150° C. and 550° C.

* * * * *